US005786767A

United States Patent [19]

Severino

[11] Patent Number: 5,786,767

[45] Date of Patent: Jul. 28, 1998

[54] HOME SAFETY SYSTEM

[76] Inventor: Joseph Severino, 1416 Pine Ridge, Bushkill, Pa. 18324

[21] Appl. No.: 840,384

[22] Filed: Apr. 29, 1997

[51] Int. Cl.[6] ..... G08B 17/10

[52] U.S. Cl. ..... 340/628; 340/577; 340/584; 340/632; 340/693

[58] Field of Search ..... 340/539, 577, 340/578, 579, 584, 586, 628, 629, 630, 632, 691, 693

[56] References Cited

U.S. PATENT DOCUMENTS

| | | | |
|---|---|---|---|
| 4,178,592 | 12/1979 | McKee | 340/693 |
| 4,189,720 | 2/1980 | Lott | 340/628 |
| 4,417,235 | 11/1983 | Del Grande | 340/628 |
| 4,433,274 | 2/1984 | Duhame | 340/628 |
| 4,570,155 | 2/1986 | Skarman et al. | 340/628 |
| 4,612,535 | 9/1986 | Sequin et al. | 340/628 |
| 4,904,988 | 2/1990 | Nesbit et al. | 340/539 |
| 5,146,209 | 9/1992 | Beghelli | 340/628 |
| 5,159,315 | 10/1992 | Schultz et al. | 340/539 |
| 5,227,776 | 7/1993 | Starefoss | 340/628 |
| 5,331,310 | 7/1994 | Stetter et al. | 340/632 |
| 5,486,811 | 1/1996 | Wehrle et al. | 340/628 |
| 5,568,130 | 10/1996 | Dahl | 340/628 |
| 5,589,824 | 12/1996 | Lynch | 340/693 |
| 5,598,456 | 1/1997 | Feinberg | 379/42 |

*Primary Examiner*—Jeffery Hofsass
*Assistant Examiner*—Daniel J. Wu
*Attorney, Agent, or Firm*—Collard & Roe, P.C.

[57] ABSTRACT

A home safety system comprising a smoke detector, a carbon monoxide detector and a microphone connected to a transmitter. The smoke detector is powerable by a/c current and by a battery, and comprises a sensor for sensing smoke connected to an audible alarm signal. The carbon monoxide detector is powerable by a/c current and by a battery and comprises a sensor for sensing the presence of carbon monoxide connected to an audible alarm signal. The transmitter comprises means for communicating signals from the carbon monoxide detector and smoke detector to a remote location. The invention further comprises an emergency lighting system connected to the carbon monoxide detector and smoke detector. The light system is powered by a battery and adapted to turn on in the event of a power failure, a signal from the smoke detector or a signal from the carbon monoxide detector. The lighting system can also be used as a night light. A portable receiver receives signals from the transmitter and broadcasts the signals to alert an individual monitoring the conditions to the presence of smoke or carbon monoxide.

7 Claims, 6 Drawing Sheets

HOME SAFETY SYSTEM

BACKGROUND OF THE INVENTION

1. Field of the Invention

This invention relates to a safety system for home use. In particular, the invention relates to a combination smoke detector, carbon monoxide detector, emergency light and intercom system that can be used to monitor the conditions in several different rooms from one remote location.

2. The Prior Art

Parents with young children often purchase intercom systems in order to be able to monitor the children from another room. These systems are particularly useful for infants, whose crying can then be detected while the parents are in another room. While these intercoms serve a useful purpose, they do not notify parents of possible environmental hazards such as smoke, and carbon monoxide that may be seeping into the child's room.

There have been several attempts to provide environmental and alarm systems that can be monitored from remote locations. U.S. Pat. No. 5,598,456 to Feinberg discloses a telephone intercom and security system that can transmit signals from a smoke alarm to a central monitoring station. U.S. Pat. No. 5,227,776 to Starefoss also discloses a system that can monitor rooms for smoke and other conditions from a central operating station. These systems suffer from the drawback that they are permanently installed in the locations being monitored and require complicated wiring.

U.S. Pat. No. 5,159,315 to Shultz et al. discloses a communication system having environmental detection capabilities. The detector comprises a smoke detector, a carbon monoxide detector or any other type of detector. The detector is connected to a transmitter such as a radio that informs the user of environmental hazards.

A second communication device can be used to receive signals from the radio to communicate the information to a central location. The radio may be optionally disconnected from the detector to allow for selective placement of the detector.

While this system may be useful to transmit environmental information from one location to another such as from police cars to a central monitoring station, it lacks several important features that are necessary for home use. First, it may be desirable to have more than one type of environmental detector connected to the transmitter. Second, it is sometimes important to have the base station that is receiving the communication be portable as well, so that a monitor, such as a parent, can move around to different locations while still monitoring environmental conditions in another location. Third, it is desirable to incorporate into the system an emergency lighting system that serves to illuminate the affected area in the event of a power outage. Fourth, it is desirable, especially for use in rooms where infants sleep, to have a system that has all of the above features but can still function as a portable intercom system for monitoring the child's behavior.

SUMMARY OF THE INVENTION

It is therefore an object of the present invention to overcome the drawbacks of the prior art and provide a combination smoke detector, carbon monoxide detector, emergency light and intercom unit that is ideal for home use.

It is another object of the present invention to provide such a combination that can be fixedly mounted on a wall in a child's room, but also adapted for use while traveling to different locations.

It is yet another object of the present invention to provide such a combination where several detectors and intercoms are able to transmit information to a single portable receiving unit.

It is a further object of the invention to provide a mechanism for the ideal placement of the smoke detector, emergency light, intercom and carbon monoxide detector while in the portable mode.

These and other objects and features of the invention are accomplished by an intercom system for monitoring smoke and carbon monoxide from a remote location, comprising a smoke detector, a carbon monoxide detector, and a microphone connected to a transmitter that is capable of transmitting the signals from the two detectors as well as sounds from the microphone to a remote receiver unit. The system also comprises an emergency lighting unit that is illuminated in the event of a power outage in the area where the detectors are placed, or if either the smoke detector or carbon monoxide detector is activated. The emergency light can also be used as a night light when equipped with a photocell for detecting darkness. If the light is intended for use as a night light, the user turns a switch on the unit which converts the light from an emergency light into a night light.

The smoke detector, carbon monoxide detector and light are all connected to individual backup batteries, so that in the event of a power outage, each unit can function independently. The smoke detector is preferably connected to the transmitter in one unit, which is preferably mounted high on a wall. The high placement is important because smoke rises. The carbon monoxide detector, however, is optimally mounted low to the ground, because carbon monoxide is heavier than air and stays low. The carbon monoxide detector is connected via a detachable wire to the transmitter. The carbon monoxide detector is preferably connected to the light in one unit.

The carbon monoxide detector has an a/c power connection so that it is plugged directly into a wall. This connection also powers the smoke detector unit through the detachable electrical cord. However, the separate batteries for each unit ensure that a failure of one unit will not affect the power of the other unit.

The base receiver unit receives the signals from the detectors and broadcasts the signals through a speaker. Several transmitters may be connected to a single receiver. Individual transmitters are identified on the base receiving unit. The identification system comprises a channel selector on each transmitter, and a channel indicator on the receiver. Each transmitter is set to a different channel. Each channel sends out a signal of a different frequency to the receiver, which detects the signal and identifies the channel on the channel indicator.

The base receiver unit is portable, so that the person monitoring the detector units can move around while continuing to monitor the conditions in the transmitting areas. The base receiver could also be equipped with its own smoke detector and carbon monoxide detector, so that the area in which the receiver is located is also being monitored for environmental hazards.

The detector units are also portable so that the system can be set up in any location. To use the system in a temporary location, the smoke detector/transmitter unit is mounted on a stand that can be placed on a counter or other surface to keep the detector at an elevated height, which is optimal for detecting smoke, since smoke tends to rise and remain in a room at an elevated level. The carbon monoxide detector/light unit is then placed on the floor and connected to the smoke detector/transmitter unit. The carbon monoxide detector is optimally placed at a low level, because carbon monoxide is heavier than air and stays at a low elevation. In the portable mode, all units run on batteries.

Alternatively, the smoke detector/transmitter unit could be used on its own, if an a/c power supply is plugged into the smoke detector unit. The a/c power supply could be any commercially available a/c power supply. This enables the smoke detector/intercom unit to be used outdoors for monitoring a child's behavior, without the need for transporting the carbon monoxide detector as well.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1A:
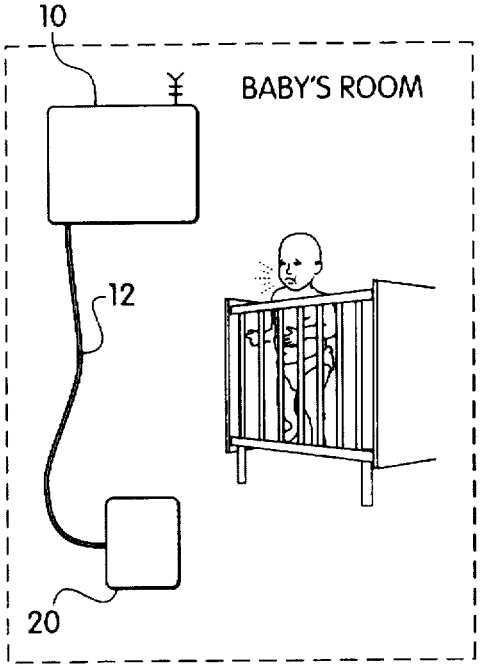
FIG. 1*a* is a schematic diagram of the smoke detector, carbon monoxide detector and intercom unit of the present invention.
Figure 1B:
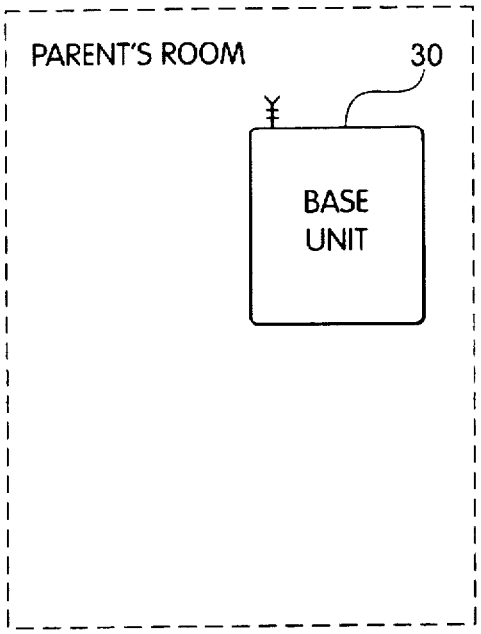
FIG. 1*b* is a schematic diagram of the base receiver unit.

Turning now in detail to the drawings, and in particular, FIGS. 1*a* and 1*b*, there is shown a schematic diagram of the system according to the invention. The system comprises a combination transmitter and smoke detector unit 10, which is mounted high on a wall in a child's bedroom. Unit 10 is connected by detachable wire 12 to carbon monoxide detector and light unit 20, which sits on or near the floor and has an a/c power connection. Units 10 and 20 each have separate back-up batteries, so that if the power of one unit fails, the other unit will still function.

The base receiver unit 30 is capable of receiving signals from units 10 and 20 in addition to sounds from the room in which units 10 and 20 are located, so that a person in another location can monitor the sounds and environmental conditions in the room.

Figure 2:
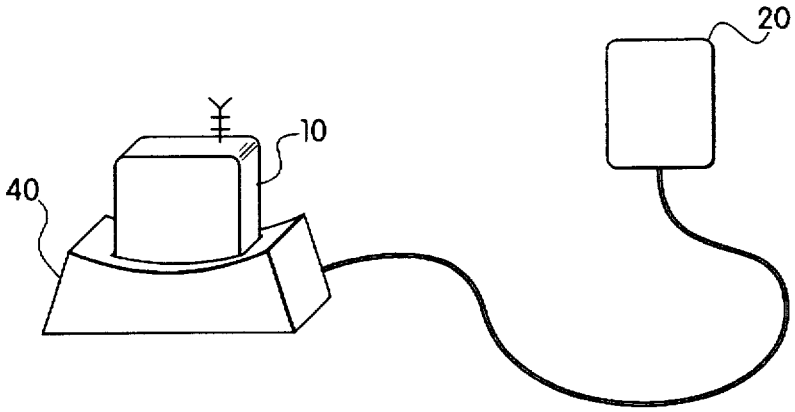
FIG. 2 is a schematic diagram of the smoke detector and carbon monoxide detector units in the portable mode.

FIG. 2 shows how the system can be used in a portable mode, to monitor the conditions in temporary location. Here, unit 10 is mounted on stand 40 and unit 20 is placed beneath stand 40. The placement of units 10 and 20 is important, because smoke detectors must be placed high in a room, and carbon monoxide detectors must be placed low. Unit 20 is either plugged into a wall socket or both units can run on their back-up batteries. This way, the system can be used while traveling as well.

Figure 3A:
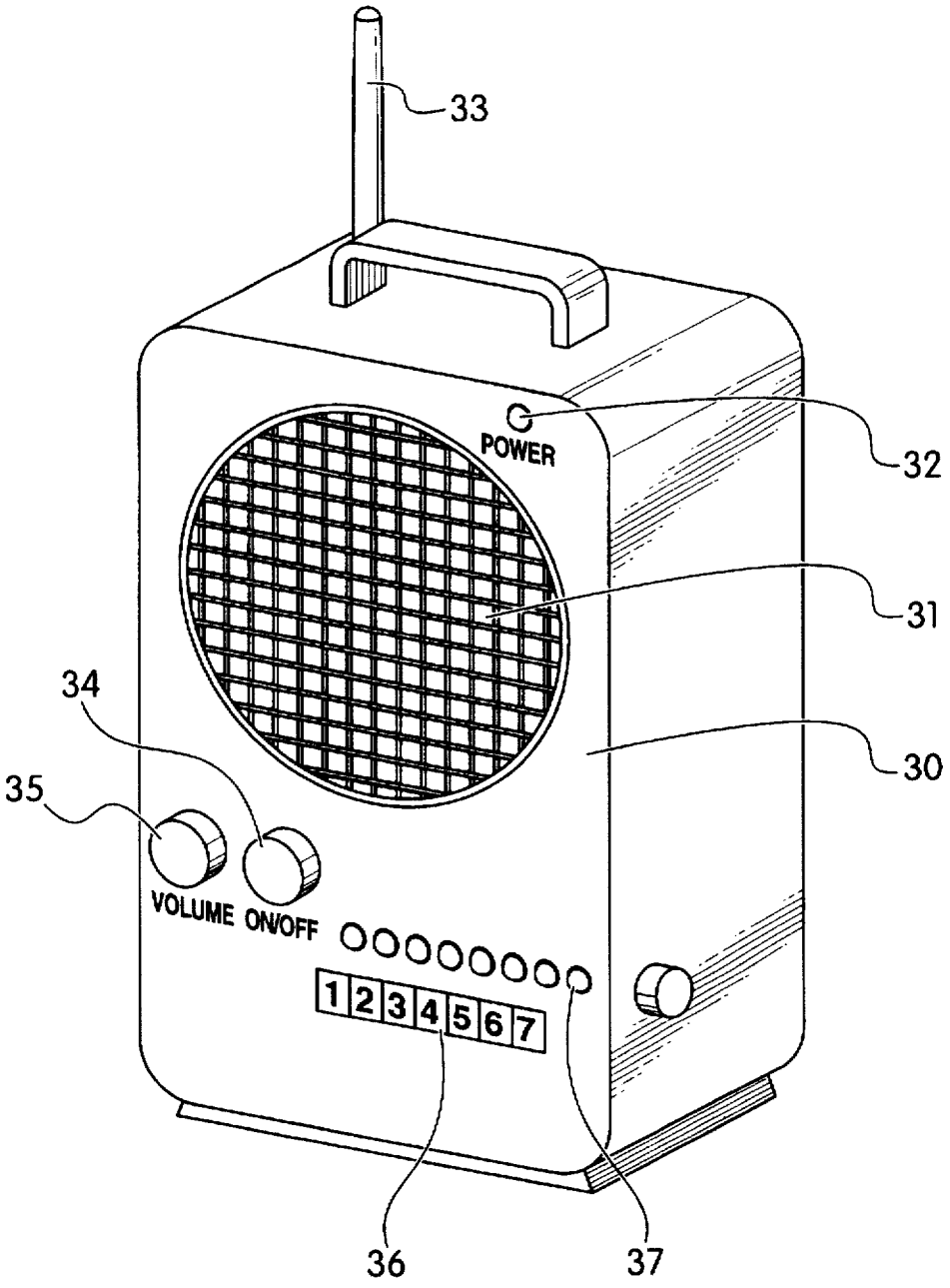
FIG. 3*a* is a perspective view of the base receiver unit.

FIG. 3*a* shows a typical construction of the base receiving unit 30. Base unit 30 has a speaker 31 for broadcasting signals from units 10 and 20. There is a volume control 35 for adjusting the volume of the broadcast signals. Power to unit 30 is controlled by button 34. When the unit is on, power light 32 is illuminated. Unit 30 is powered by plugging it into a wall socket, or it can run on a battery. Preferably, unit 30 is equipped with both a battery and a wall socket connection so that it can be powered by either method. Antenna 33 allows unit 30 to receive strong signals from the transmitting units.

Unit 30 is equipped to receive signals from several different detector units when each unit sends signals of a different frequency, as indicated by a channel selector. Each frequency is assigned to a different channel. When a specific frequency is received by unit 30, one of lights 37 is illuminated and the channel to which the frequency corresponds is indicated by panel 36. Each channel corresponds to a different detector unit, so that the illumination of one of lights 37 indicates from which transmitter the signal came. Unit 30 is designed to be portable so that a parent who wishes to monitor his or her children can move around to different locations and still have the ability to monitor the sounds and environmental conditions in one or several different rooms.

Figure 3B:
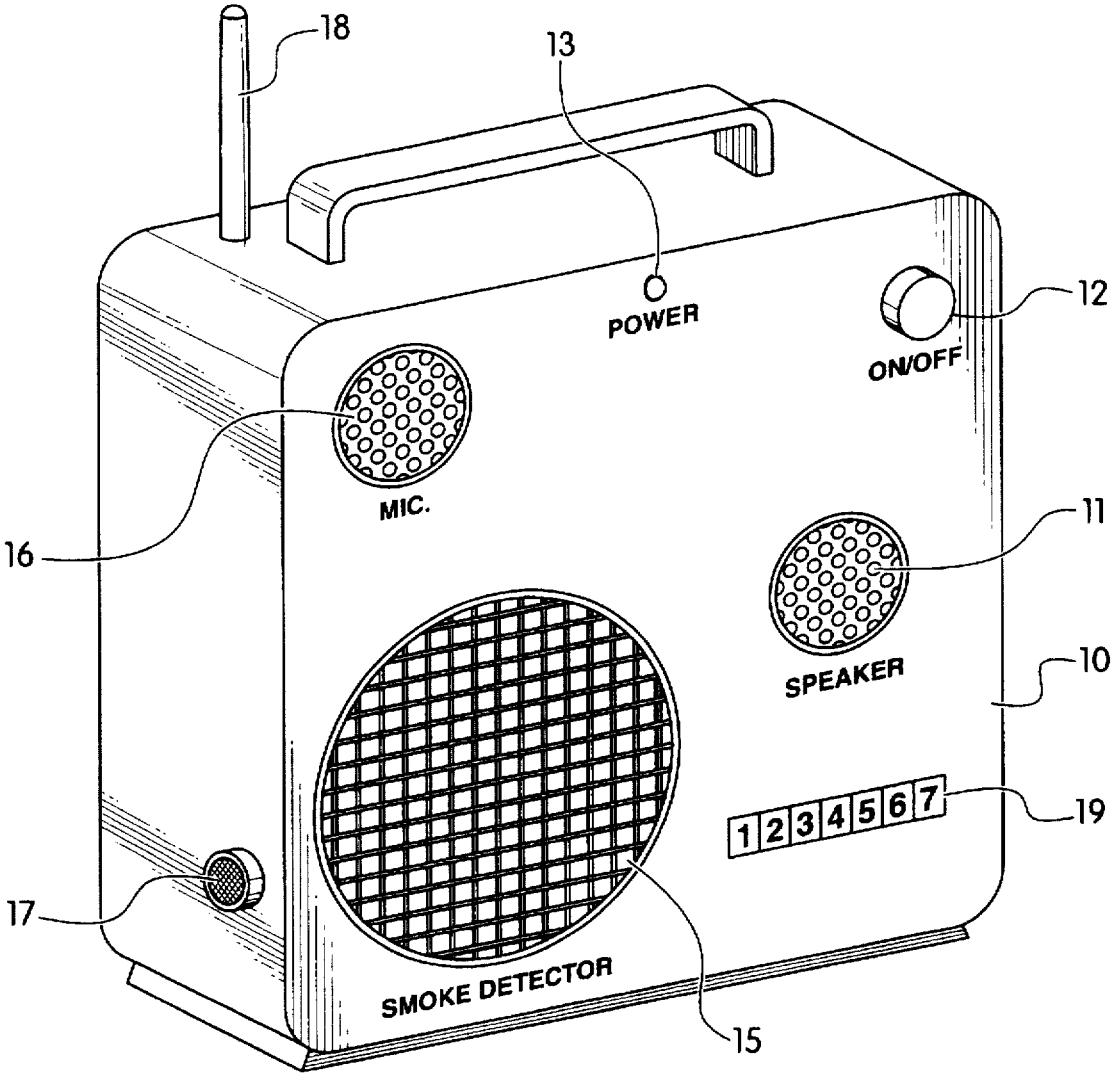
FIG. 3*b* is a perspective view of the smoke detector unit.

FIG. 3*b* shows a typical design of one of the smoke detector units 10 according to the invention. Unit 10 is equipped with a smoke detector 15 which detects the presence of smoke in the room and sends out an audible signal to alert occupants of the presence of smoke. Speaker 11 broadcasts the signals from smoke detector 15 into the room in which unit 10 is placed. Unit 10 is also equipped with a microphone 16, which is capable of picking up sounds from the room and sending them through a transmitter to a receiver in base unit 30, which is in a remote location.

Unit 10 can be turned off and on by power switch 12. Power light 13 is illuminated when unit 10 is turned on. The power to unit 10 is supplied either by connecting unit 10 to an electrical outlet through unit 20, or through a built-in battery. The battery also functions as a back-up battery and keeps unit 10 powered in the event that the electricity in the house fails. Unit 10 can be connected to unit 20 (shown in FIGS. 4*a*–4*b*) by plugging an electrical cord into receptacle 17.

There is a channel selector 19 located on unit 10, to select a channel through which the signals from unit 10 will be transmitted. Each channel on channel selector 19 corresponds to a different frequency. As explained above, each channel is received and identified by base unit 30, so that a person monitoring several different units can identify the unit from which the signal came. When several different intercom units are being used, each unit is set to a different channel on channel selector 19.

Figure 4A:
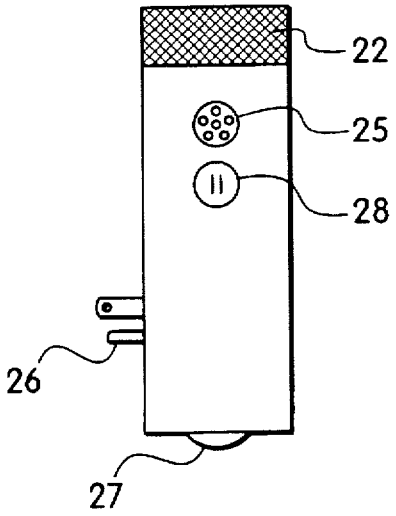
FIG. 4*a* is a side view of the carbon monoxide detector and light unit according to the present invention.
Figure 4B:
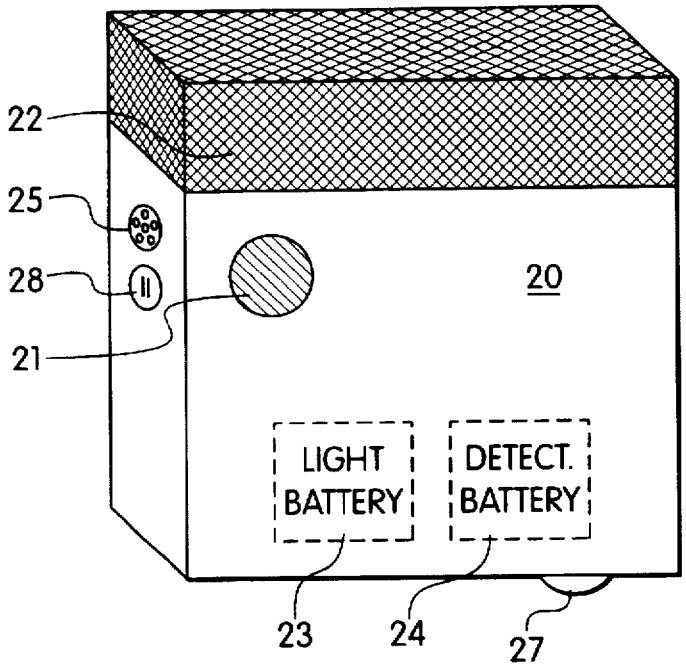
FIG. 4*b* is a front perspective view of the carbon monoxide detector and light unit according to the present invention.

FIGS. 4*a*–4*b* show the carbon monoxide/emergency light unit 20 according to the present invention. Unit 20 includes a carbon monoxide detector 21 and an emergency light 22. The light 22 and carbon monoxide detector 21 are each connected to their own backup batteries 23 and 24, respectively. As shown in FIG. 4*a*, unit 20 is intended to be plugged directly into a wall via plug 26. Batteries 23 and 24 are used only in the event that the electricity in the house fails, or if the units are to be used in a portable mode.

Emergency light 22 is wired to turn on in the event that the electricity in the house fails, or one or both of the carbon monoxide detector or smoke detector alarms is activated. This feature is important because it immediately illuminates the space in which the environmental hazard is detected, regardless of whether the power in the house is on or not. This saves a rescuer time, especially at night, because any occupants can be immediately seen and rescued without having to look for light switches or turn on flashlights.

In addition, light 16 can also be used as a night light. Photocell 27 is located on the bottom of unit 20 and senses when the light in the room is diminished. Photocell 27 then causes light 16 to turn on. Whether light 16 is used as a night light or an emergency lighting unit is determined by switch 28.

Unit 20 is connected to unit 10 by attaching an electrical cord to receptacle 25. This connection allows both units 10 and 20 to be powered by the electricity in the house.

Figure 5:
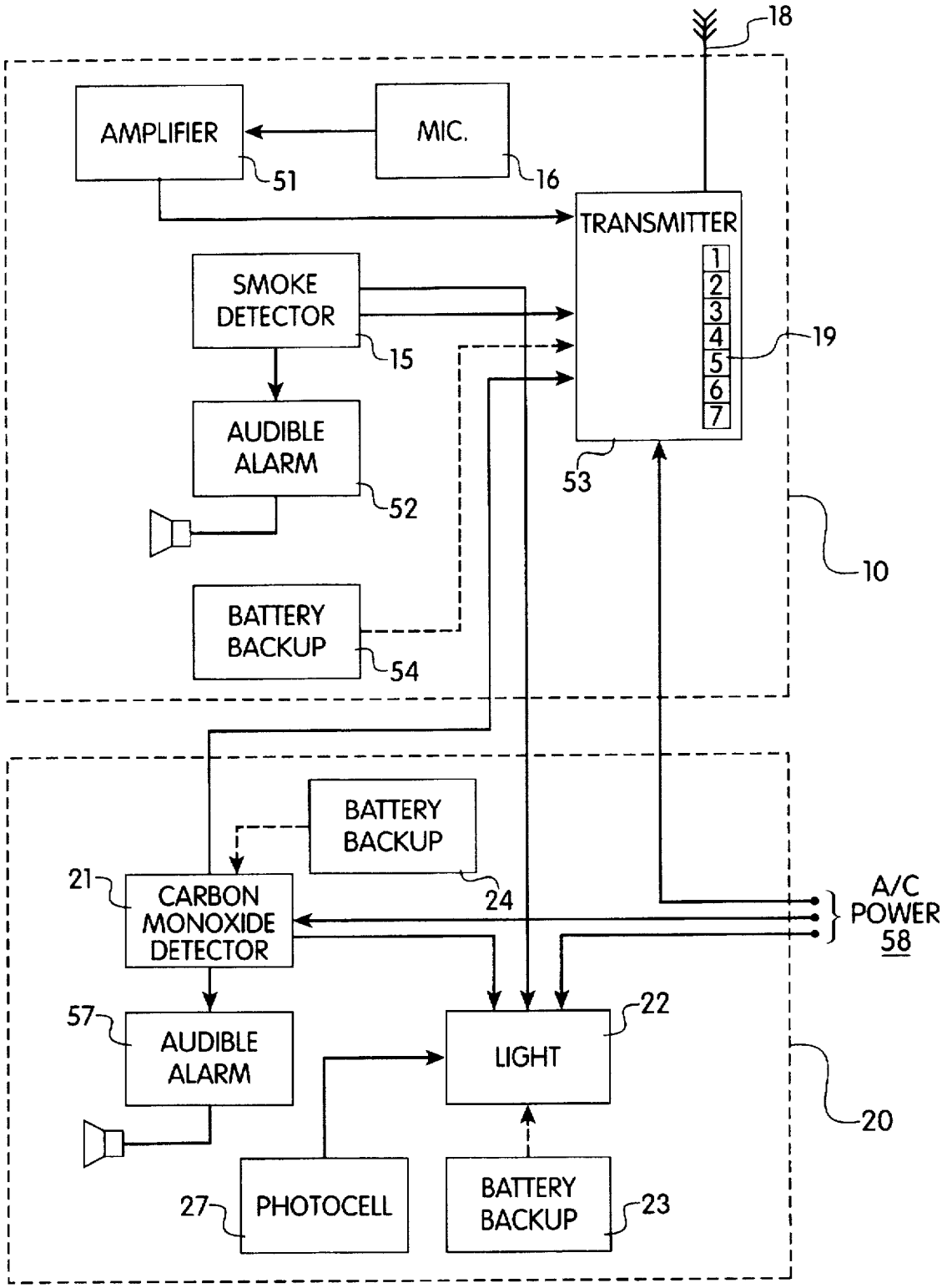
FIG. 5 is a block diagram of the smoke detector and carbon monoxide detector units according to the present invention.

FIG. 5 shows a schematic diagram of the elements of units 10 and 20. Unit 10 contains transmitter 53, which receives signals from smoke detector 15 and carbon monoxide detector 21 and transmits these signals through antenna 18 to base receiving unit 30. Microphone 16 is also connected to transmitter 53 through an amplifier 51, which amplifies the sounds collected by microphone 16. This way, sounds from the room in which the transmitter is located, such as a baby's crying, are also transmitted to base receiving unit 30.

Smoke detector 15 is connected to an audible alarm 52, which sounds when smoke is detected by detector 15. Smoke detector 15 is also connected to light 22 on unit 20 to illuminate light 22 in the event that smoke is detected.

A battery backup 54 is connected to transmitter 53 and keeps unit 10 operational in the event of a power failure. Transmitter 53 is connected to the a/c power 58 through a connection to unit 20. All of the connections between units 10 and 20 are contained within detachable power cord 12 (shown in FIG. 1*a*), which connects receptacle 17 on unit 10 (shown in FIG. 3*b*) to receptacle 25 on unit 20 (shown in FIGS. 4*a* and 4*b*).

Unit 20 contains carbon monoxide detector 21 connected to an audible alarm 57, which sounds when detector 21 detects the presence of carbon monoxide. Detector 21 is connected to an individual battery backup to keep detector 21 operational in the event of a power failure. Detector 21 is also connected to light 22 and causes light 22 to illuminate if carbon monoxide is detected in the area. Both detector 21 and light 22 are connected to a/c power supply 58. Power supply 58 supplies the power to both units 10 and 20. In addition, a failure of power supply 58 causes light 22 to illuminate.

Light 22 is also connected to a photocell 27 so that light 22 can be used as a night light, if desired. Photocell 27 detects the amount of light in the room. If the room is dark, light 22 is illuminated. When the room becomes light, light 22 turns off. The use of light 22 as an emergency light or a night light is determined by switch 28, shown in FIGS. 4*a* and 4*b*.

Figure 6:
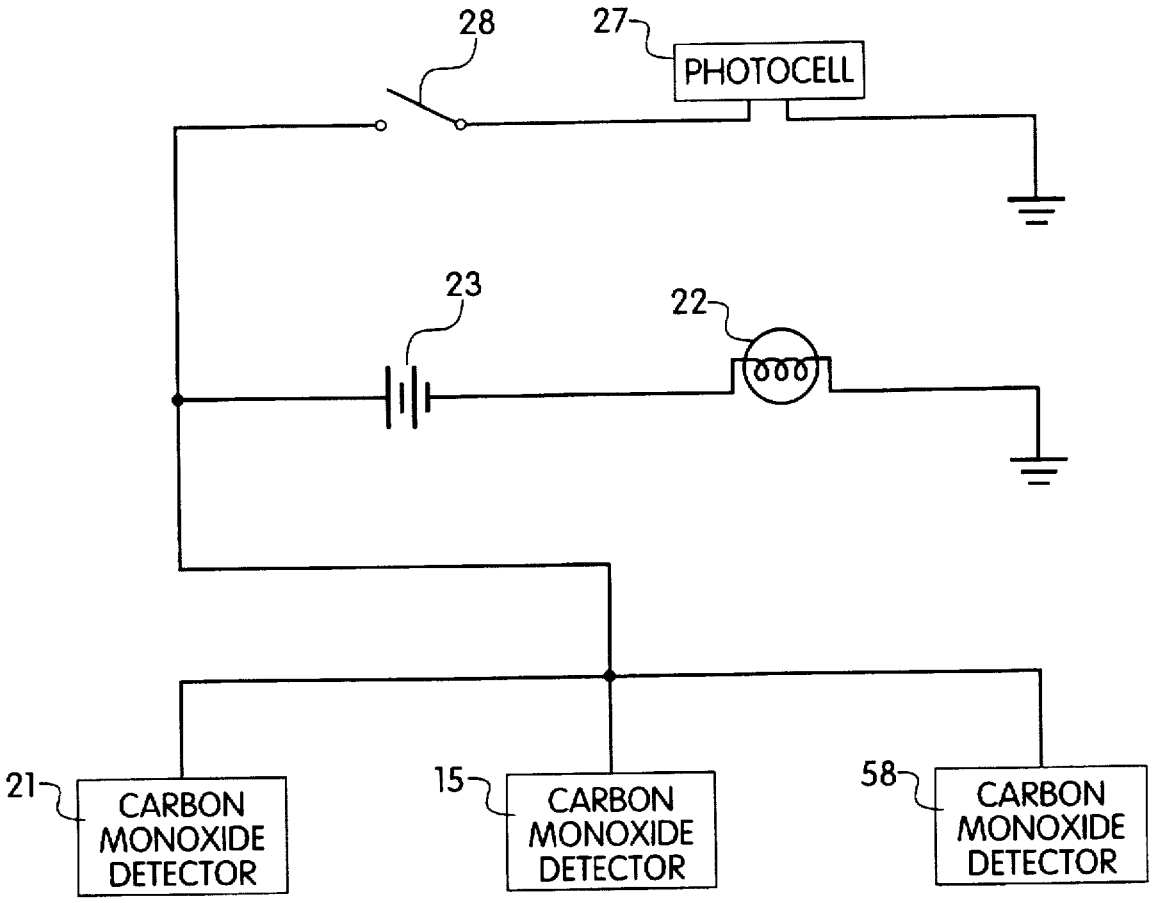
FIG. 6 is a block diagram of the wiring for the emergency light unit.

FIG. 6 shows the circuit that is connected to emergency light 22. This circuit ensures that light 22 stays off until one of several events occurs: (1) a signal from either the smoke detector or carbon monoxide detector; (2) a power outage; or (3) darkness in the room plus activation of switch 28. The circuit shows that battery 23, light 22, photocell 27 and switch 28 are connected in series. Closing switch 28 creates a closed circuit and causes light 22 to illuminate when photocell 27 senses that the room is dark. When switch 28 is open, light 22 remains off.

Light 22 will turn on even when switch 28 is open, if smoke detector 15 or carbon monoxide detector 21 are activated, or if a/c power 58 goes out in the room. Either one of these three events triggers the closing of a circuit and illuminates light 22.

Accordingly, while only one embodiment of the present invention has been shown and described, it is obvious that many changes and modifications may be made thereunto without departing from the spirit and scope of the invention.

What is claimed is:

1. A home safety system, comprising:

a smoke detector powerable by a/c current and a battery, said smoke detector comprising a sensor for sensing smoke connected to an audible alarm signal;

a carbon monoxide detector powerable by a/c current and by a battery, said detector comprising a sensor for sensing the presence of carbon monoxide connected to an audible alarm signal;

an emergency light system connected to the carbon monoxide detector and smoke detector, said light system adapted to turn on in the event of a power failure, a signal from the smoke detector or a signal from the carbon monoxide detector;

a microphone for detecting sounds in the surrounding area;

a transmitter connected to the smoke detector, carbon monoxide detector and microphone, said transmitter comprising means for communicating signals from the carbon monoxide detector and smoke detector as well as sounds detected by the microphone to a remote location; and a portable receiver for receiving the signals and sounds from the transmitter and broadcasting said signals and sounds.

2. The system according to claim 1, wherein the portable receiver is adapted to receive signals from more than one transmitter and further comprising means on the receiver for identifying each transmitter sending a signal.

3. The system according to claim 2, wherein each transmitter comprises a channel selector for setting each transmitter to an individual channel, wherein each channel causes the transmitter to send out a signal of a different frequency, and wherein the means on the receiver for identifying each transmitter comprises a channel indicator on the receiver, such that when a signal from a transmitter is received, the channel indicator identifies the channel of the transmitter from which the signal originated.

4. The system according to claim 1, further comprising a second smoke detector and second carbon monoxide detector connected to the receiver.

5. The system according to claim 1, wherein the smoke detector and transmitter are connected as an integral unit, and wherein the carbon monoxide detector is detachably connected to the transmitter through a wire, so that the smoke detector and carbon monoxide detector can be individually positioned for optimal detection.

6. The system according to claim 5, further comprising a portable stand adapted to hold the smoke detector and transmitter at an elevated level for optimal detection.

7. The system according to claim 1, further comprising a photocell and a switch connected to the emergency lighting system, wherein turning the switch causes the lighting system to illuminate in dark conditions, and turn off in light conditions.

* * * * *